US006655443B2

(12) United States Patent
Mochizuki et al.

(10) Patent No.: US 6,655,443 B2
(45) Date of Patent: Dec. 2, 2003

(54) SHUTTER

(75) Inventors: Masanori Mochizuki, Yao (JP); Kenji Mochizuki, Yao (JP)

(73) Assignee: Isel Co., Ltd., Osaka (JP)

( * ) Notice: Subject to any disclaimer, the term of this patent is extended or adjusted under 35 U.S.C. 154(b) by 0 days.

(21) Appl. No.: 10/219,282

(22) Filed: Aug. 16, 2002

(65) Prior Publication Data

US 2003/0037888 A1 Feb. 27, 2003

(30) Foreign Application Priority Data

Aug. 23, 2001 (JP) ..... 2001-252852
Jul. 24, 2002 (JP) ..... 2002-214907

(51) Int. Cl.[7] ..... E05D 15/16
(52) U.S. Cl. ..... 160/201; 160/229.1
(58) Field of Search ..... 160/201, 229.1, 160/232, 233, 234, 235, 207, 133

(56) References Cited

U.S. PATENT DOCUMENTS 3,101,485 A * 8/1963 Kirshenbaum ..... 160/201
4,345,635 A * 8/1982 Solomon ..... 160/235 X
4,432,591 A * 2/1984 Rinkewich ..... 160/232 X
5,265,663 A * 11/1993 Munekata et al. ..... 160/235 X
5,850,862 A * 12/1998 Miller ..... 160/235 X

* cited by examiner

*Primary Examiner*—David Purol
(74) *Attorney, Agent, or Firm*—Fitch, Even, Tabin & Flannery

(57) ABSTRACT

A shutter includes a shutter panel 10 having a plurality of plates 1 which are rotatably connected to one another by hinge members 2, and a pair of guide rails 4 formed with guide grooves 40 which slidably hold opposite end edges of the shutter panel 10. By using the hinge members 2 which connect the adjacent plates 1 to each other so that the plates are rotatably bent only in a direction in which a curvature becomes greater than a portion of the guide groove 40 having a minimum curvature, it is possible to smoothly open and close the shutter even when the curvature of the guide rail 4 is varied along the sliding direction of the shutter panel 10.

15 Claims, 15 Drawing Sheets

PRIOR ART

PRIOR ART

SHUTTER

BACKGROUND OF THE INVENTION

1. Field of The Invention

The present invention relates to a shutter, and more particularly to a hinge member rotatably connecting plates to each other, the plates constituting a shutter panels.

2. Disclosure of The Invention

Japanese Publication No. 61-137792A, Utility model, discloses one example of a shutter panels having a configuration shown in FIG. 14 in which a plurality of plates are rotatably connected to one another by hinge members.

A shutter panel 10 in this example includes slats 18 and hinge members 2. The slats 18 each have a plate 1 and a cylindrical portion 17 which is integrally and continuously provided on the plate 1 along opposite end edges thereof on the side of its long side. The hinge members 2 each include holding portions 28 each turnably fitted over the cylindrical portion 17, and a reinforcing member 29 provided between the holding portions 28. The shutter panel 10 is slidably held by a pair of guide rails 4.

As shown in FIG. 14, each holding portion 28 of the hinge member 2 has a C-shaped section formed with a slit along its longitudinal direction such that the cylindrical portion 17 is rotatable and is prevented from being pulled out. As shown with broken lines in FIG. 14, the holding portion 28 is rotatably fitted over the cylindrical portion 17 in a range between opened end edges of the slit.

Since the shutter has such a configuration, if the shutter panel 10 is held by guide grooves 40 of the guide rails 4 having curved portions R and is allowed to slide as shown in FIG. 15, the shutter panel 10 is automatically bent along the curved portions R of the guide rails 4 and slides in the guide grooves 40. When the shutter panel 10 is not used, it can be wound around a cylindrical drum disposed above the guide rails 4 and can be accommodated compactly.

However, the shutter panel 10 can easily be bent and extended straightly along the guide rails 4 or a take-up drum. Therefore, there is a problem that when the shutter panel 10 slides, the plates 1 are unnecessarily pivoted and caught by the guide grooves 40, and the shutter can not be opened and closed smoothly.

Such a problem appears remarkably when the guide rails 4 have the curved portions R, and if the shutter panel is indiscriminately bent as shown in FIG. 12, the plates 1 or hinges 2 are caught by the guide grooves 40 of the curved portions R, and the shutter panel 10 can not slide in some cases.

In such a case, it is necessary to once pull the shutter panel 10 to its initial state to improve the indiscriminate bending thereof, and to allow the shutter panel 10 to slide in its normal direction again, and there is a problem that it is necessary to repeat the same operation many times until the shutter panel 10 passes through the curved portions R without being caught by the guide grooves 40.

SUMMARY OF THE INVENTION

An object of the present invention is to provide a shutter including: a shutter panel having a plurality of plates rotatably connected to one another by means of hinge members; and a pair of guide rails formed with guide grooves for slidably holding opposite end edges of the shutter panel, thereby smoothly opening and closing the shutter even if a curvature of each the guide rail is varied along a sliding direction of the shutter panel.

To achieve the above object, a shutter of the present invention has a feature that the hinge member can be bent only in a direction in which a curvature becomes greater than a portion of the guide groove having a minimum curvature.

The adjacent plates are selectively rotatably bent only in a direction in which the curvature of the guide groove becomes greater. Therefore, when the shutter panel is allowed to slide along the guide grooves, the plates are prevented from being rotatably bent in a direction in which the curvatures become smaller and prevented from being caught by the guide grooves. Thus, a minimum curvature portion of the guide rail and the curved portion of the shutter panel smoothly slide.

Since the present invention has the above configuration, the following specific effect is obtained.

The shutter panel slides smoothly in the minimum curvature portion and curved portion of each the guide rail. Therefore, the shutter is smoothly opened and closed even if the curvature of the guide rail is varied along the sliding direction of the shutter panel.

Other object, features, aspects and advantages of the invention will become more apparent from the following detailed description of embodiments with reference to the accompanying drawings and appended claims.

DETAILED DESCRIPTION OF THE INVENTION

Embodiments of the present invention will be explained in detail with reference to the drawings.

First Embodiment

Figure 1:
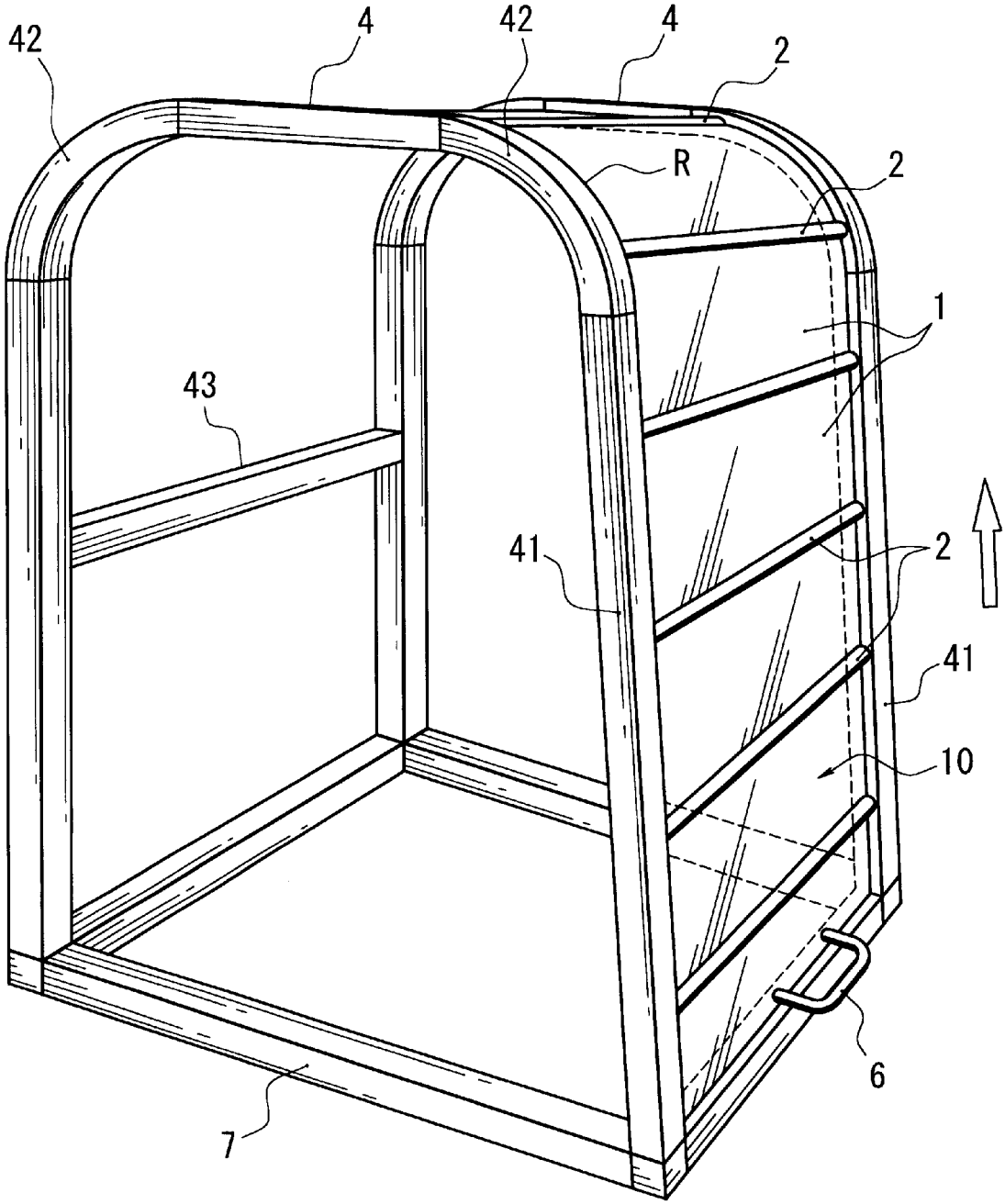
FIG. 1 is a perspective view showing an entire configuration of a shutter in a first embodiment of the present invention.

FIG. 1 shows a shutter according to a first embodiment of the present invention.

As shown in FIG. 1, the shutter of the first embodiment includes a pair of guide rails 4 each having curved portion R, a shutter panel 10 slidably held between the guide rails 4, and a rectangular foundation frame 7 on which the guide rails 4 are placed and fixed.

As shown in FIG. 1, each of the guide rails 4 is formed into a reversed U-shape by alternately connecting aluminum straight members 41 and arc curved members 42 to each other. Opposed end surfaces of the guide rails 4 are continuously formed with U-shaped guide grooves 40 over entire length of the rail for slidably holding the shutter panel 10. The shutter is provided at its back surface with a side frame 43 for horizontally connecting the guide rails 4 as a stopper of the shutter panel 10.

Figure 2:
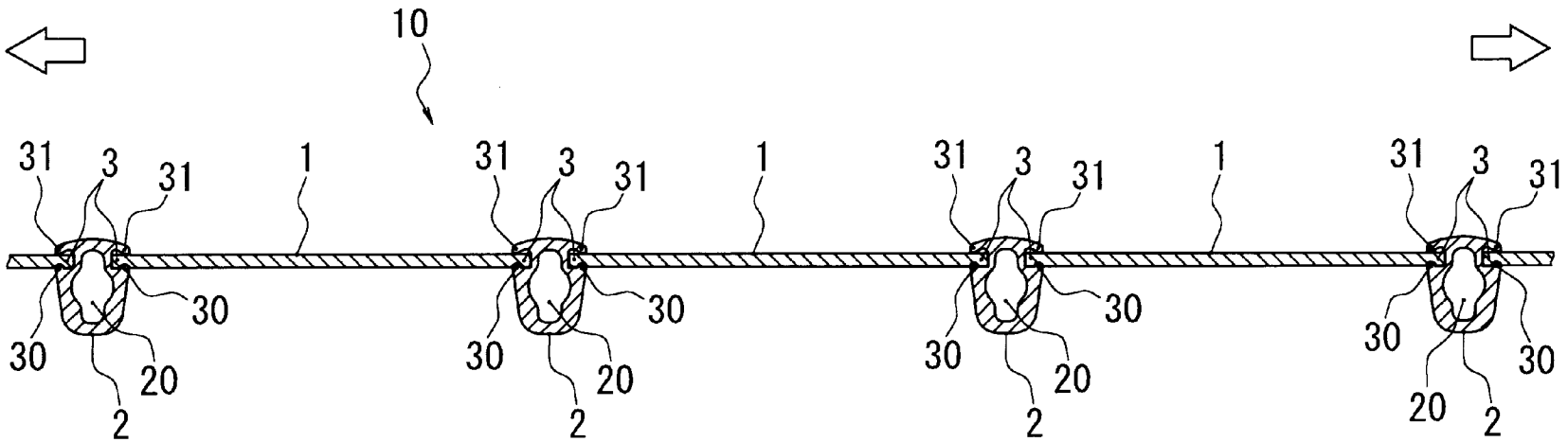
FIG. 2 is a sectional view of a shutter panel used for the shutter of FIG. 1.

As shown in FIGS. 1 and 2, the shutter panel 10 includes transparent synthetic resin plates 1, and hinge members 2 rotatably connecting end edges of the plates 1 to each other. A grip 6 for slidably moving the shutter panel 10 is mounted to a lower portion of the shutter panel 10.

Recessed grooves 13 having semi-circular sections are formed in opposite end edges of long side in one of the surfaces of the plate 1. The recessed grooves 13 are turnably engaged with projecting portions 30 formed in side grooves 3 of the hinge member 2 which will be described later.

Figure 3:
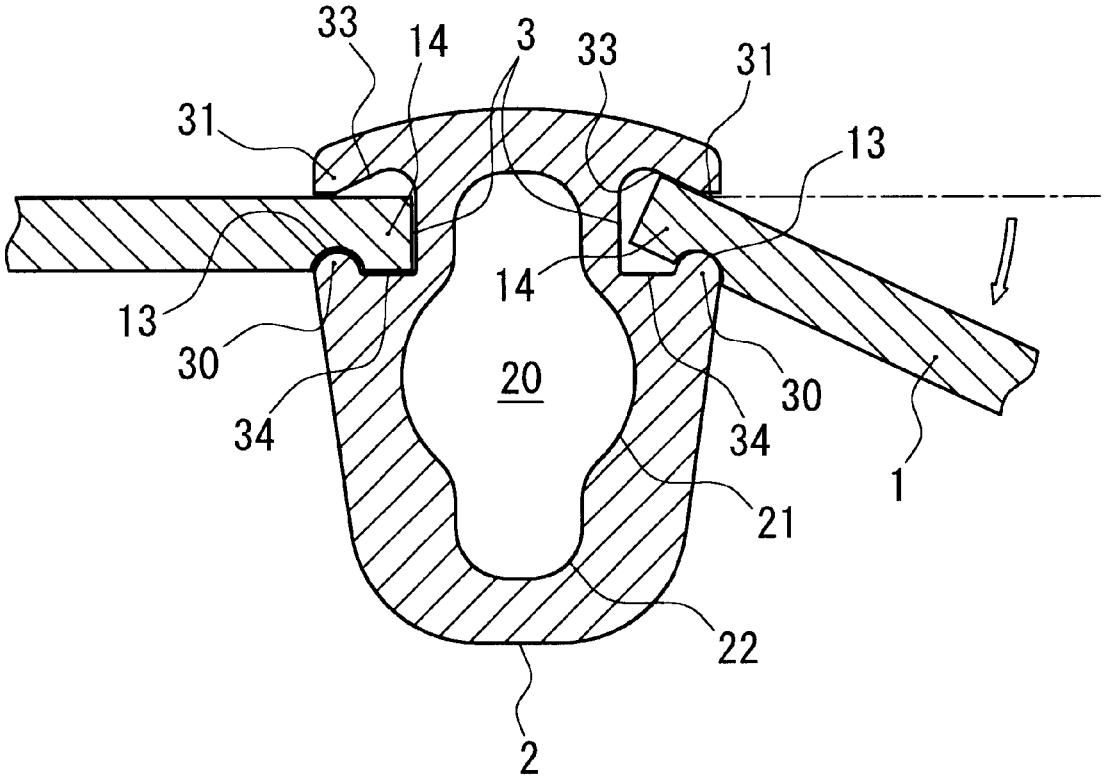
FIG. 3 is a sectional view showing a connecting state between a hinge member and plates.

As shown in FIG. 3, the hinge member 2 is a columnar body having a rectangular section which is long in the vertical direction. The hinge member 2 is formed with a hollow portion 20 for reducing its weight. An upper end of the hinge member 2 is formed with a pair of side grooves 3 for holding the end edge of the plate 1 such that the plate 1 is rotatable and is prevented from being pulled out. The side grooves are opened in opposite directions from each other and are formed symmetrically laterally. The hollow portion 20 has such a shape that angular cylindrical portions 22 each having a rectangular section and formed along a longitudinal direction of the hinge member 2, and a cylindrical portion 21 having a circular section are combined.

The side groove 3 has a U-shape capable of accommodating a tip end 14 on the side of the end edge of the plate 1 rather than the recessed groove 13. The projecting portion 30 which is turnably fitted to the recessed groove 13 of the plate 1 is formed on the upper opened end edge of the side groove 3, and the opened end of the side groove 3 is smaller than a thickness of the plate 1. Therefore, if the plate 1 is inserted from the opened end of the side groove 3 in the longitudinal direction such that the projecting portion 30 is fitted into the recessed groove 13, thereby allowing them to slide, the plate 1 can be held by the hinge member 2.

As shown with a broken line in FIG. 3, when the adjacent plates 1 assume a straight attitude through the hinge member 2, the lower opened end edge of the side groove 3 is formed with a reverse movement-preventing portion 31 which abuts against a surface of the plate 1 to prevent the plate 1 from turning in a direction opposite from the curving direction of the guide rail 4 from the straight attitude.

As shown in a right side of FIG. 2, on each of upper opposite inner walls of the side grooves 3, there is formed a normal movement-preventing portion 33 which abuts against the tip end 14 to prevent the plate 1 from turning in the normal direction when the plate 1 is turned through a predetermined angle. As shown in a left side of FIG. 3, on each of lower opposite inner walls of the side grooves 3, there is formed a reverse movement-preventing portion 34 which abuts against the tip end 14 to prevent the plate 1 from turning in the reverse direction together with the reverse movement-preventing portion 31.

The normal movement-preventing portion 33 is set such that it meets a maximum curvature of the curved portion R of the guide rail 4 so that the plate 1 is not excessively turned in the normal direction of the guide rail 4 and does not hinder the sliding movement when the shutter panel 10 slides.

Next, a case where the shutter is actually closed will be explained.

When the shutter is closed, as shown in FIG. 1, most of the shutter panel 10 is held straightly along the straight member 41 on the front surface side, and about upper ¼ thereof is held in a state in which it is bent along the curved member 42 which forms the curved portion R.

When the grip 6 is grasped from the closed state and the shutter panel 10 is pulled upward in a direction shown with an arrow in FIG. 1, each plate 1 of the shutter panel 10 is supported such that the plate 1 is not turned in a direction opposite from the curving direction of the curved member 42 by the reverse movement-preventing portions 31 and 34. Therefore, the shutter panel 10 slides on the straight member 41 straightly.

When the shutter panel 10 comes around the curved member 42 from the straight member 41, the plates 1 are sequentially turned in the normal direction along the curved surface of the curved member 42, and rotatably bent into a shape corresponding to the curved member 42. At that time, excessive turning motion of the plate 1 in the normal direction is prevented by the normal movement-preventing portion 33.

Next, if the shutter panel 10 passes through the curved member 42 and slides on the straight member 41 on the top of the shutter, the plate 1 is turned in the reverse direction and supported by the reverse movement-preventing portions 31 and 34. Therefore, the shutter panel 10 assumes the original straight attitude.

Also when the shutter panel 10 is pulled down to its original closed state from the opened state in which a front surface of the shutter is opened, the shutter panel 10 is bent or extended smoothly along the straight member 41 or the curved member 42 like a case where the shutter is opened.

As described above, in the shutter of this embodiment, since the plate 1 is supported by the reverse movement-preventing portions 31 and 34, the plate 1 is rotatably bent selectively only in the curving direction of the curved member 42. Therefore, when the shutter panel 10 slides between the straight member 41 and the curved member 42, the plate 1 and the hinge member 2 are not caught by the guide groove 40. Further, the plate 1 is prevented from being excessively bent in the curving direction of the curved member 42 by the normal movement-preventing portion 33 as shown with arrows in FIG. 2. With this, even if the curvature of the guide rail 4 is varied along the sliding direction of the shutter panel 10, it is possible to smoothly open and close the shutter.

In this embodiment, the plate 1 is held by the side groove 3 formed by notching a side wall of the hinge member 2 so that a force acting on the plate 1 can be supported by the side groove 3 and the hinge member 2 which is continuous with the side groove 3. Therefore, the shutter panel 10 has a high strength against a force acting on a surface of the shutter panel 10 perpendicularly as shown with arrows in FIG. 4. Further, since the plate 1 is held by fitting the projecting portion 30 into the recessed groove 13, the plate land the hinge member 2 are less prone to be separated from each other. Therefore, the shutter panel 10 has high strength against the force acting on the plate 1 in the connecting direction. With this, the shutter panel 10 has high endurance against an external force, an impact and the like irrespective of whether the shutter panel 10 bends or not.

In this example, the side groove 3 is formed on the upper end of the hinge member 2 in a deviated manner and thus, the lower portion of the side groove 3 is great and a load applied to the shutter panel 10 can securely be supported. Therefore, the strength of the shutter panel 10 against the force acting thereon perpendicularly is enhanced further.

Figure 4:
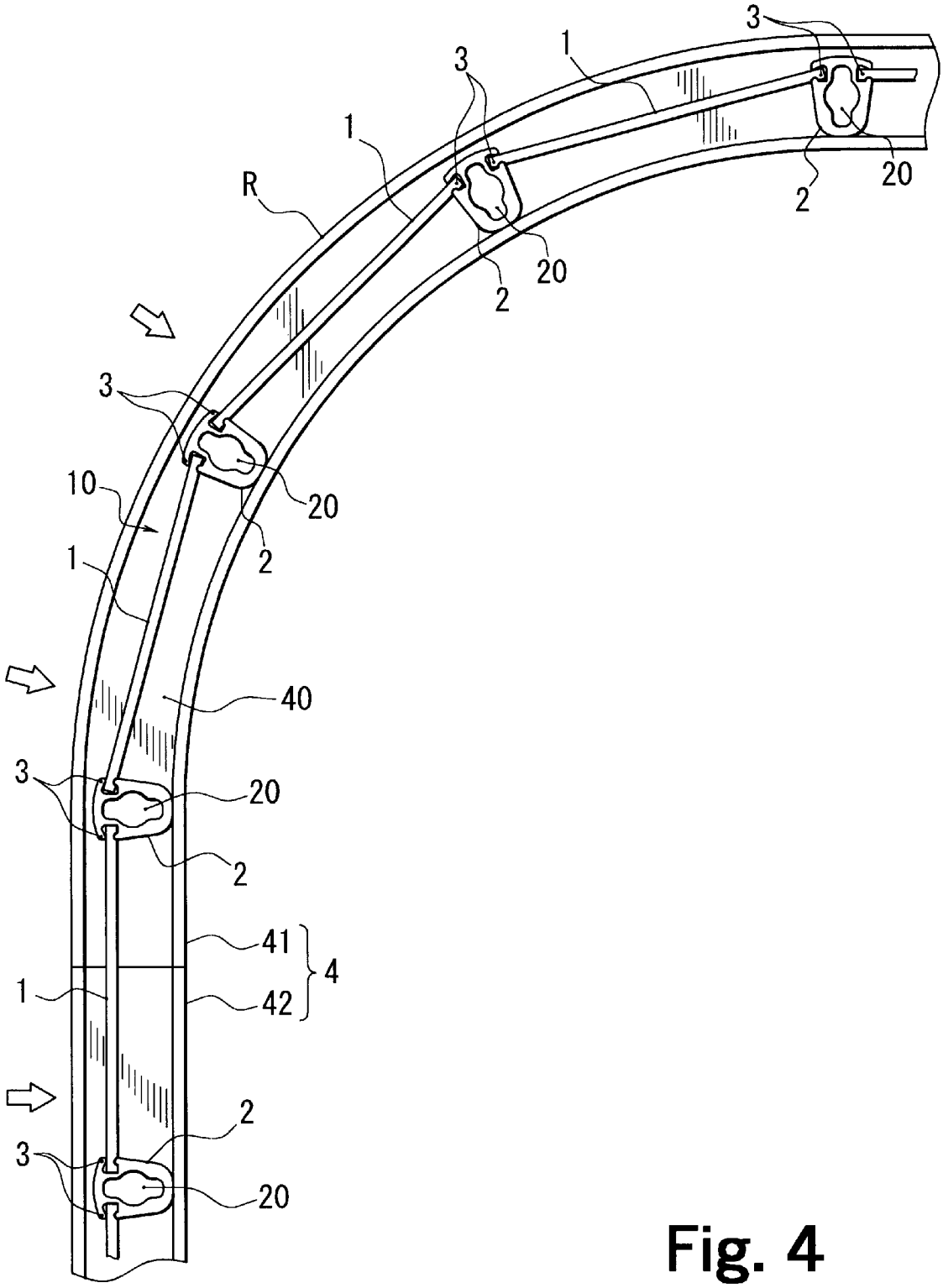
FIG. 4 is an explanatory view for showing a sliding state of the shutter panel in guide rails.

In this embodiment, as shown in FIG. 4, the plate 1 held by the hinge member 2 slides near outer side of the guide groove 40. Therefore, when the shutter panel 10 is bent in the curved portion R, the plate 1 is less prone to come into contact with or be caught by the guide groove 40. With this feature, the shutter panel 10 slides smoothly, and the plate 1 is less prone to be damaged. Further, as shown in FIGS. 2 and 4, a difference in height between a top of the hinge member 2 and a surface of the plate 1 is small, and the surface of the shutter panel 10 is substantially flat and thus, an outward appearance of the shutter is excellent.

In this embodiment, the pair of opposed inner walls of the side groove 3 function as the normal movement-preventing portion 33 and the reverse movement-preventing portion 34, respectively. Therefore, the plate and the hinge member 2 are less prone to be damaged as compared with one in which the opened end edge of the side groove 3 functions as the normal movement-preventing portion and the reverse movement-preventing portion, and endurance of the shutter panel is high.

Further, in this embodiment, since the plate 1 is turnably held by fitting the projecting portion 30 into the recessed groove 13, a resistance generated when the plate 1 is turned is small as compared with a shutter in which the entire cylindrical portion 17 of the plate 1 is inscribed with the holding portion 28 of the hinge member 2 as described in the prior art. Therefore, the shutter panel is rotatably bent and extended smoothly.

Second Embodiment

Figure 5:
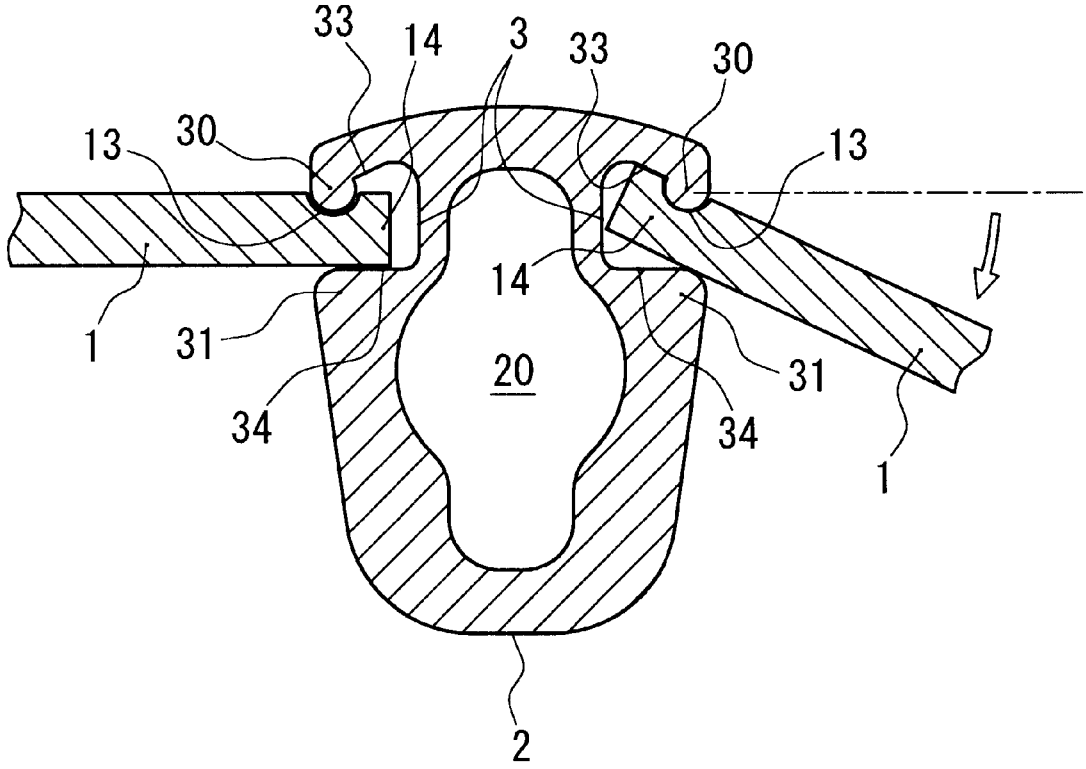
FIG. 5 is a sectional view showing a connecting structure between the hinge member and the plates used in a shutter of second embodiment.

FIG. 5 shows a configuration in which the projecting portion 30 which is to be fitted into the recessed groove 13 of the plate 1 is formed on the upper opened end edge of the side groove 3.

In this embodiment, portions of the hinge member 2 except the side groove 3 and the plate 1 held by this are the same as those of the above-described first embodiment.

The projecting portion 30 having a semi-circular section is formed on the upper opened end edge of the side groove 3 along a longitudinal direction thereof, and the reverse movement-preventing portion 31 which abuts against the plate 1 and prevents the plate 1 from turning in the reverse direction is formed on the lower opened end edge.

Like the first embodiment, the normal movement-preventing portion 34 which abuts against the tip end 14 of the plate 1 and prevents the plate 1 from being excessively turned in the normal direction is formed on each of the upper opposed inner walls of the side groove 3. The reverse movement-preventing portion 34 for preventing the plate 1 from being turned in the reverse direction together with the reverse movement-preventing portion 31 is formed on each of the lower opposed inner walls.

Since the second embodiment has such a configuration, this shutter has the same effect as that of the first embodiment.

Third Embodiment

Figure 6:
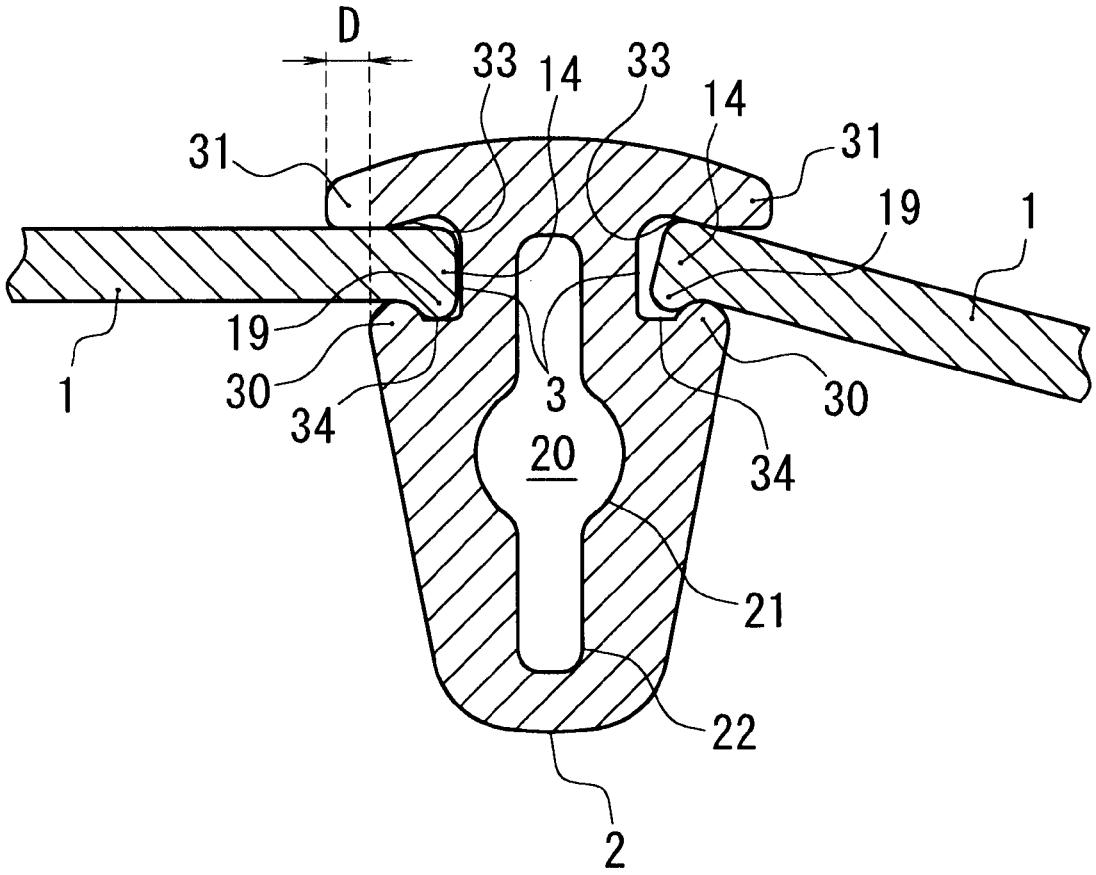
FIG. 6 is a sectional view showing a connecting structure between the hinge member and the plates used in a shutter of third embodiment.

FIG. 6 shows a configuration in which the projecting portion 30 of the hinge member 2 and a projection 19 formed on an end edge of the plate 1 on the long side are engaged with each other rotatably.

The hinge member 2 in this embodiment is formed into a trapezoidal shape whose lateral width is gradually reduced from an upper end toward a lower end thereof. Like the first embodiment, a pair of side grooves 3 for holding the plate 1 such that the plate 1 is rotatable and is prevented from being pulled out are formed on the upper end of the hinge member 2 symmetrically laterally.

As shown in FIG. 6, the side grooves 3 are formed such that height of upper groove side walls on which the reverse movement-preventing portion 31 and the normal movement-preventing portion 33 are formed on the opposite inner surfaces thereof is higher, by a predetermined length D, than height of lower groove side walls on which the projecting portion 30 and the reverse movement-preventing portion 34 are formed.

As shown in FIG. 6, the projection 19 projects from one surface of the plate 1 held by the side groove 3. The projection 19 has a curved surface which coincides with an arc shape of the projecting portion 30 of the side groove 3. The projection 19 is turnably engaged with the projecting portion 30.

Since the third embodiment has such a configuration, in this third embodiment, like the first embodiment, the plate 1 is restrain from turning by the normal movement-preventing portion 33, the reverse movement-preventing portions 31 and 34 and thus, it is possible to smoothly open and close the shutter even if the curvature of the guide rail 4 is varied along the sliding direction of the shutter panel 10.

Further, the shutter has a high strength against a force acting on the surface of the shutter panel 10 perpendicularly, and as shown in FIG. 6, the plate 1 is held by the engagement between the projecting portion 30 and the projection 19. Therefore, the shutter has a strength against a force acting in the connecting direction of the plate 1. With this, the shutter panel 10 has a high endurance against an external force, an impact and the like irrespective of whether the shutter panel 10 bends or not.

In this example, since the projecting portion 30 and the projection 19 are turnably engaged with each other, a resistance generated when the plate is turned is small, and the shutter panel bends and extends smoothly as compared with the first embodiment in which the projecting portion 30 is fitted into the recessed groove 13.

If the shutter panel 10 is held along the straight member 41 which uprightly stands on a place surface as shown in the shutter of FIG. 1, when liquid such as water scatter or radiate onto a back surface of the shutter panel 10 by a machine tool accommodated in the shutter, liquid flowed and dropped through the plate 1 enters into the side groove 3 from the lower groove side wall on which the projecting portion 30 is formed. Then, the liquid flowed to a front surface of the plate 1 through a bottom of the side groove 3, but since the liquid can not climb over a high groove side wall on which the normal movement-preventing portion 33 is formed and therefore, the liquid flows out toward the back surface of the shutter panel 10 from the low groove sidewall. Therefore, in this embodiment, it is possible to prevent liquid such as water from flowing toward the front surface of the shutter panel 10.

In this embodiment, the hinge member 2 has a section shape whose lateral width is gradually reduced from its upper end toward its lower end. Therefore, if the inside of the shutter is viewed through the transparent synthetic resin plate 1 from outside the shutter panel 10, the hinge member 2 does not easily come within sight of a person, and an outward appearance is excellent.

Fourth Embodiment

Figure 7:
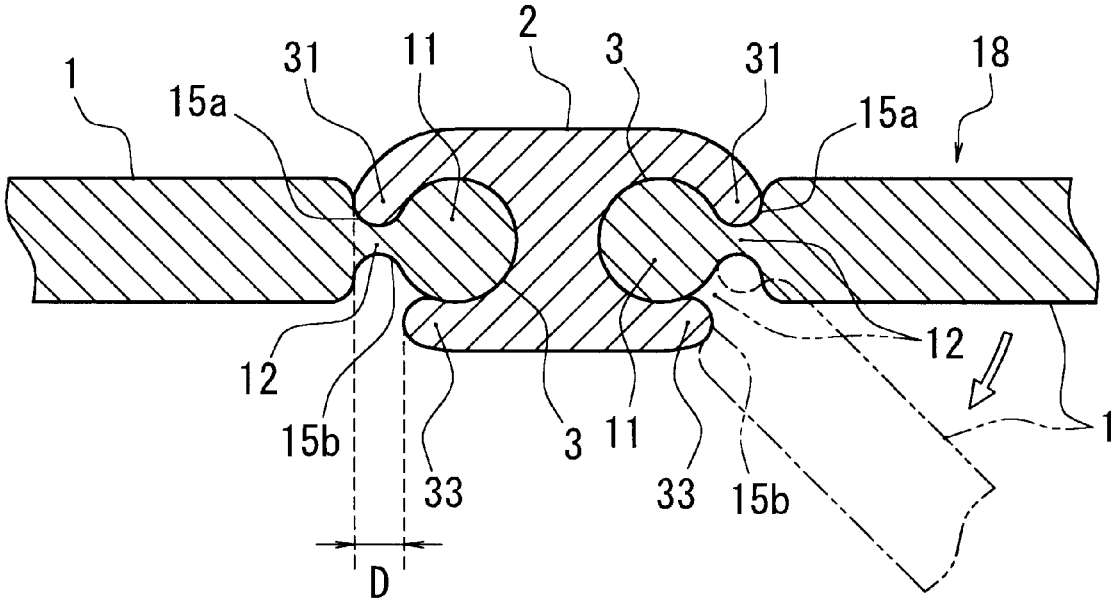
FIG. 7 is a sectional view showing a connecting structure between the hinge member and the plates used in a shutter of a fourth embodiment.

FIG. 7 shows a shutter in which a pair of opened end edges of the side groove 3 function as the reverse movement-preventing portion 31 and the normal movement-preventing portion 33.

In this embodiment, the shutter includes slats 18 each provided with a cylindrical column 11 through a thin neck 12 on each of the opposite end edges of the plate 1, and a hinge member 2 formed with a pair of side grooves 3 for holding the cylindrical column 11 such that the cylindrical column 11 can turn and is prevented from being pulled out. The side grooves 3 are formed symmetrically laterally.

The side groove 3 has a C-shaped section. Reverse movement-preventing portions 31 are formed on upper opened end edges of the side grooves 3 as shown in FIG. 7. The reverse movement-preventing portion 31 is fitted into a groove 15*a* formed between the cylindrical column 11 and the plate 1 to prevent the plate 1 from being turned in the reverse direction when the adjacent plates 1 assume a straight attitude. Further, as shown with a broken line in FIG. 7, normal movement-preventing portions 33 are formed on lower opened end edges of the side grooves 3. The normal movement-preventing portion 33 is fitted into the groove 15*b* when the plate 1 is turned along the curved portion R of the guide groove 40 and prevents the plate 1 from excessively turning in the normal direction of the plate 1.

In this embodiment, like the first embodiment, since the turning motion of the plate 1 is limited by the action of the normal movement-preventing portion 33 and the reverse movement-preventing portion 31, it is possible to smoothly open and close the shutter even if the curvature of the guide rail 4 is varied along the sliding direction of the shutter panel 10.

The cylindrical column 11 and the plate 1 are connected to each other through the thin neck 12. Therefore, even if the plate 1 is thick, it is possible to connect the plates 1 to each other using the hinge member 2 having small side grooves 3 such that the plates 1 can bend freely.

In this embodiment, the normal movement-preventing portion 33 and the reverse movement-preventing portion 31 formed on the opened end edges of the side grooves 3 are fitted into the grooves 15*a* and 15*b*. Therefore, the plate 1 and the hinge member 2 are less prone to be damaged and it is possible to prevent liquid such as water from flowing toward the front surface of the shutter panel 10 as compared with a shutter in which the plate 1 is prevented from turning by the abutment, and the endurance of the shutter panel 10 is high.

Like the third embodiment, since the height of groove side wall on the side of the opposite direction side of the side groove 3 is higher than the groove side wall on the side of the normal direction by the height D, it is possible to prevent liquid such as water from flowing out toward the front surface of the shutter panel 10.

Fifth Embodiment

Figure 8:
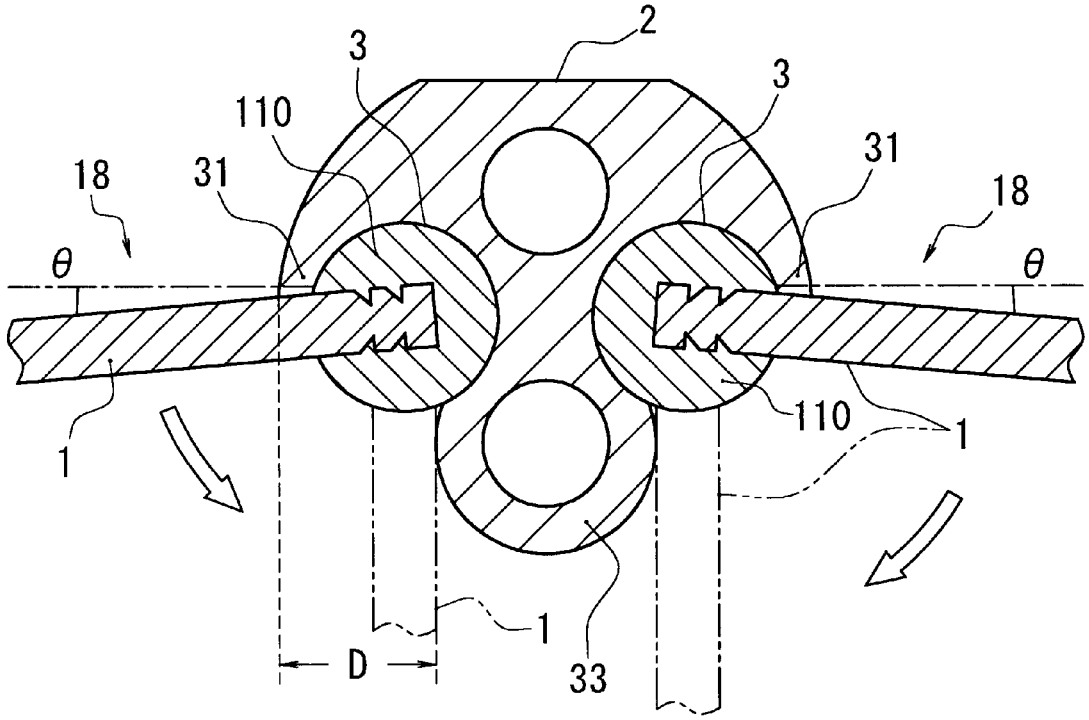
FIG. 8 is a sectional view showing a connecting structure between the hinge member and the plates used in a shutter of fifth embodiment.

FIG. 8 shows a shutter in which the plates 1 are prevented from turning in the opposite direction with a minimum curvature at which the adjacent plates 1 are turned through predetermined angles θ through the hinge member 2.

As shown in FIG. 8, the shutter of this embodiment includes slats 18 each having a cylindrical column 110 which is fitted into end edge of a long side of the plate 1, and a hinge member 2 having a T-shaped section. The hinge member 2 is formed with a pair of C-shaped side grooves 3 formed in its longitudinal direction for holding the cylindrical column 110 such that the cylindrical column 110 is rotatable and is prevented from being pulled out.

The upper opened end edges of the side grooves 3 are formed with reverse movement-preventing portions 31 which abut against the plates 1 and prevent them from turning in the reverse direction. The lower opened end edge of the hinge member 2 is formed with a normal movement-preventing portion 33 which prevents the plate 1 from excessively turning in the normal direction.

As shown with a chain line in FIG. 8, the reverse movement-preventing portion 31 prevents the adjacent plates 1 from turning in the reverse direction from a state in which the plates 1 are turned in the curving direction of the guide groove 40 through a predetermined angle θ. The predetermined angle θ is set to a value at which the shutter panel 10 can smoothly slide in the minimum curvature portion of the guide rail 4.

According to this embodiment, like the first embodiment, since the turning motion of the plate 1 is limited by the action of the normal movement-preventing portion 33 and the reverse movement-preventing portions 31 and 34, it is possible to smoothly open and close the shutter even if the curvature of the guide rail 4 is varied along the sliding direction of the shutter panel 10.

Further, in this example, since the plates 1 are connected to one another in a state in which the plates 1 are previously bent in the curving direction of the guide rail 4, the shutter panel 10 can slide more smoothly on the curved portion R of the guide rail 4 like the previous embodiment as compared with a shutter in which the plates 1 assume a straight attitude through the hinge member 2.

Further, since the cylindrical column 110 is turnably held by the side groove 3, it is possible to turn the plate over a range of 90° to 100° from the straight state in the normal direction as shown in FIG. 8. Therefore, it can correspond to the guide rail 4 having the curved portion R having a great curvature. Further, as shown with a broken line in FIG. 8, it is possible to bend the adjacent plates into a folded state.

Further, like the third embodiment, the side groove 3 is formed such that the height of the groove side wall on the side of the opposite direction is higher than the groove side wall on the side of the normal direction by the height D. Therefore, it is possible to prevent liquid such as water from flowing out toward the front surface of the shutter panel 10.

Sixth Embodiment

Figure 9:
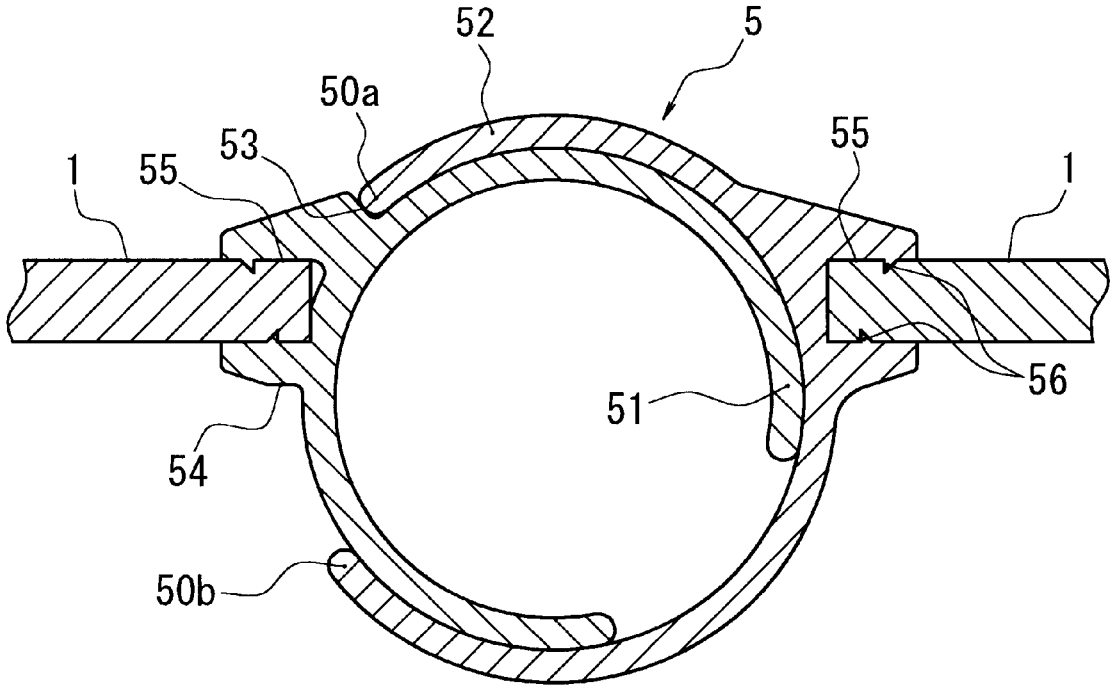
FIG. 9 is a sectional view showing a connecting structure between the hinge member and the plates used in a shutter of sixth embodiment.

FIG. 9 shows a hinge member 2 using a hinge cylinder 5 comprising an inner cylinder 51 and an outer cylinder 52.

This embodiment includes the plates 1, and the hinge cylinder 5 which is continuously formed on the end edges on the side of the long side of the plates 1 for rotatably connecting the adjacent plates 1.

As shown in FIG. 9, the hinge cylinder 5 includes the inner cylinder 51 having a C-shaped section and the outer cylinder 52 having a C-shaped section which is turnably fitted over the inner cylinder 51. A pair of holding portions 55 including projected pieces projected from side walls of the inner cylinder 51 and the outer cylinder 52. The holding portions 55 are formed along a longitudinal direction of the shutter and are inserted into the end edges of the plates 1.

Engaging projections 56 sandwich the plate 1 inserted into the holding portions 55 such that the plate 1 is prevented from being pulled out. The engaging projections 56 are formed in opposed inner surfaces of the projected pieces.

Figure 10:
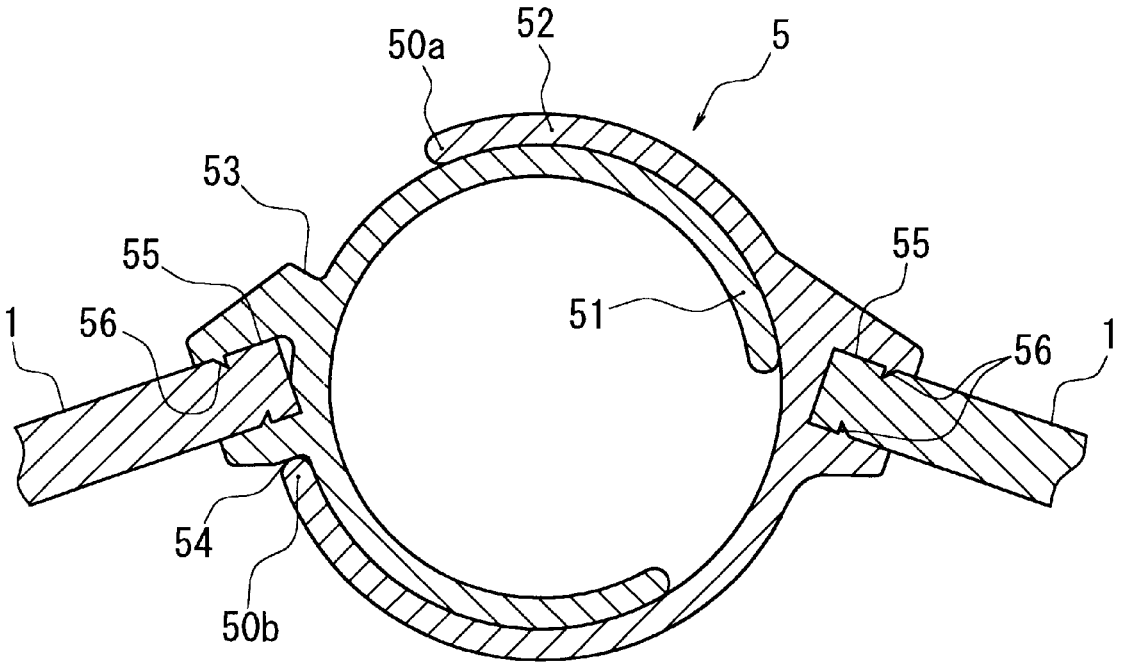
FIG. 10 is a sectional view showing a state where the shutter panel of the sixth embodiment is bent.

The inner cylinder 51 is formed at its side wall with a reverse movement-preventing portion 53 and a normal movement-preventing portion 54. One opened end edge 50*a* of the outer cylinder 52 abuts against the reverse movement-preventing portion 53 to prevent the plate 1 from turning in the reverse direction when the adjacent plates 1 are straightly connected to one another through the hinge cylinder 5. The other opened edge 50*b* of the outer cylinder 52 abuts against the normal movement-preventing portion 54 to prevent the plate 1 from excessively turning in the normal direction when the inner cylinder 51 and the outer cylinder 52 are turned in the curving direction of the guide groove 40 as shown in FIG. 10.

According to such a configuration, the plates 1 are supported by the reverse movement-preventing portion 53 and are selectively freely bent only in the curving direction of the guide groove 40. Therefore, when the shutter panel 10 slides along the guide rail 4, the plate 1 and the hinge member 2 are not caught by the guide groove 40. Further, the plate 1 is prevented from being pivoted excessively in the normal direction by the normal movement-preventing portion 54. With this, the shutter panel slides on the straight portion of the guide rail substantially straightly, and slides on the curved portion R while being rotatably bent along the guide groove 40. Therefore, it is possible to smoothly open and close the shutter even if the guide rail 4 has the straight portion and the curved portion.

According to this embodiment, since the outer cylinder 52 and the inner cylinder 51 of the hinge cylinder 5 are mutually turned, the shutter panel 10 is bent and extended smoothly.

Seventh Embodiment

Figure 11:
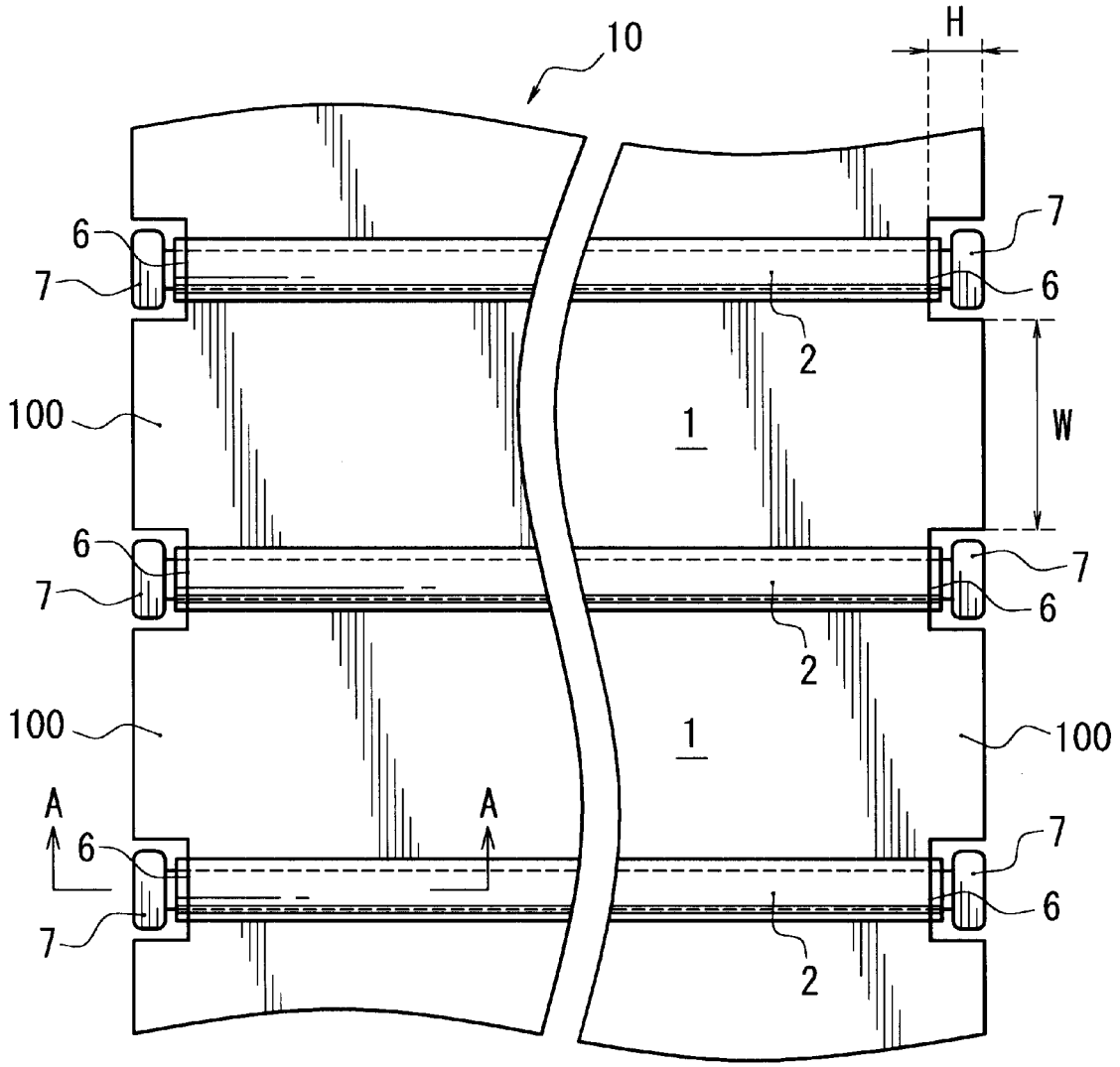
FIG. 11 is a sectional view showing a shutter panel used in a seventh embodiment.

FIG. 11 shows a shutter panel 10 in which escape-preventing plates 6 and rollers 7 are mounted to opposite ends of the hinge members 2 in their longitudinal direction.

Figure 12:
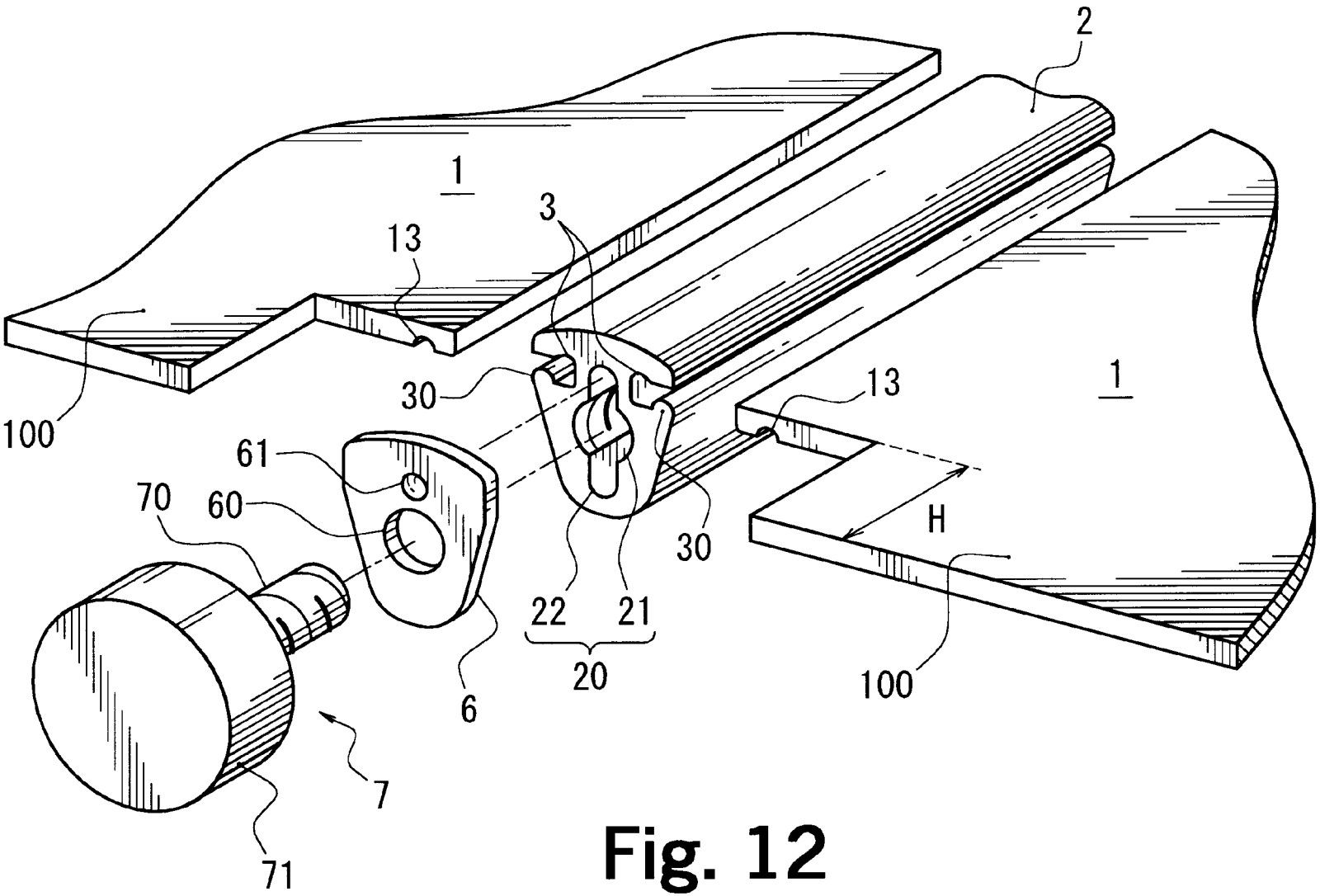
FIG. 12 is an exploded perspective view showing a connecting structure of various members of the shutter panel of the seventh embodiment.

As shown in FIGS. 11 and 12, the shutter panel 10 of this embodiment includes plates 1 to which rectangular extending pieces 100 are continuously formed on opposite ends on the short side of the plates 1, hinge members 2 used in the shutter of the first embodiment, the escape-preventing plates 6 each having the same shape as that of the hinge member 2, and the rollers 7 through which the escape-preventing plates 6 are inserted and held from the outside of the escape-preventing plates 6 and which are threadedly secured to the hollow portions 20 of the hinge members 2. A configuration of the connecting portion between the plate 1 and the hinge member 2, and a limiting mechanism of the turning motion of the plate 1 by means of the side groove 3 are the same as those in the first embodiment.

As shown in FIG. 11, a length H of each extension piece 100 is set to the same length as the projecting height from an end of the hinge member 2 connecting the plates 1 to an end of a turning head 71 of the roller 7 mounted to the former end. A width W of the extension piece 100 is set such that a gap generated between the extension piece 100 and the roller 7 is small and the extension piece 100 does not abut against the roller 7 when the shutter panel 10 slides.

Figure 13:
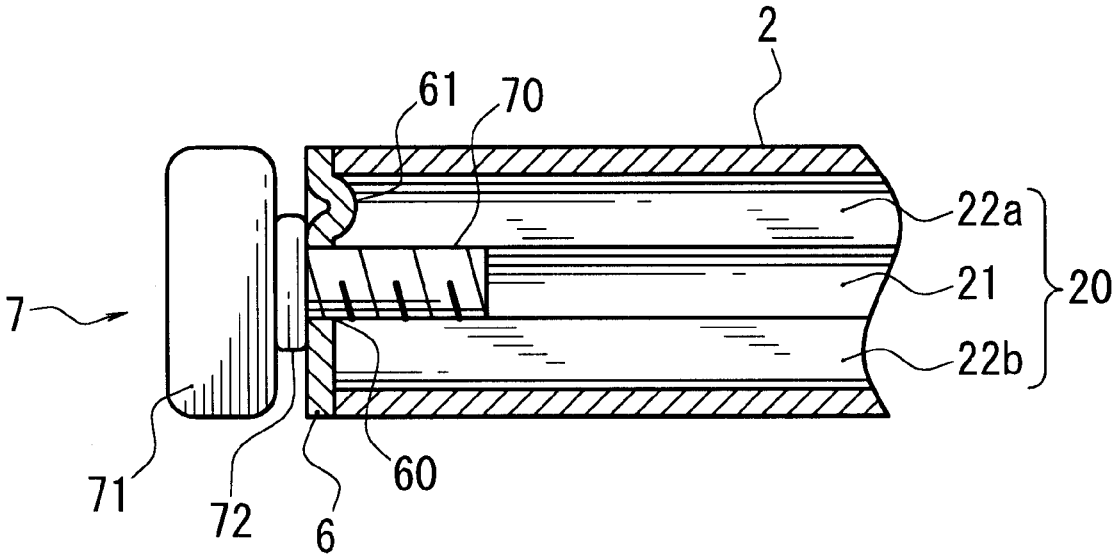
FIG. 13 is a sectional view taken along a line A—A in FIG. 11.
Figure 14:
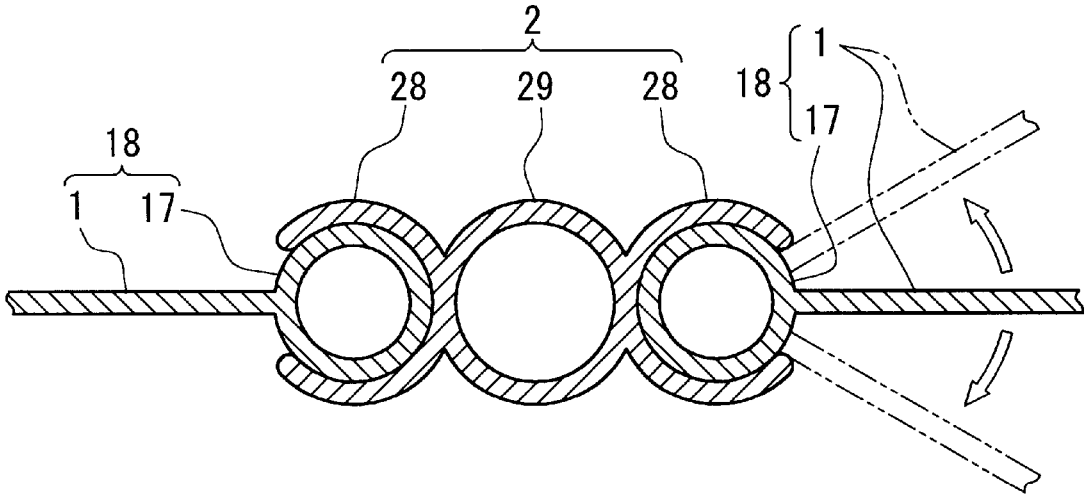
FIG. 14 is a sectional view showing a connecting structure between a hinge member and plates used in a conventional technique.
Figure 15:
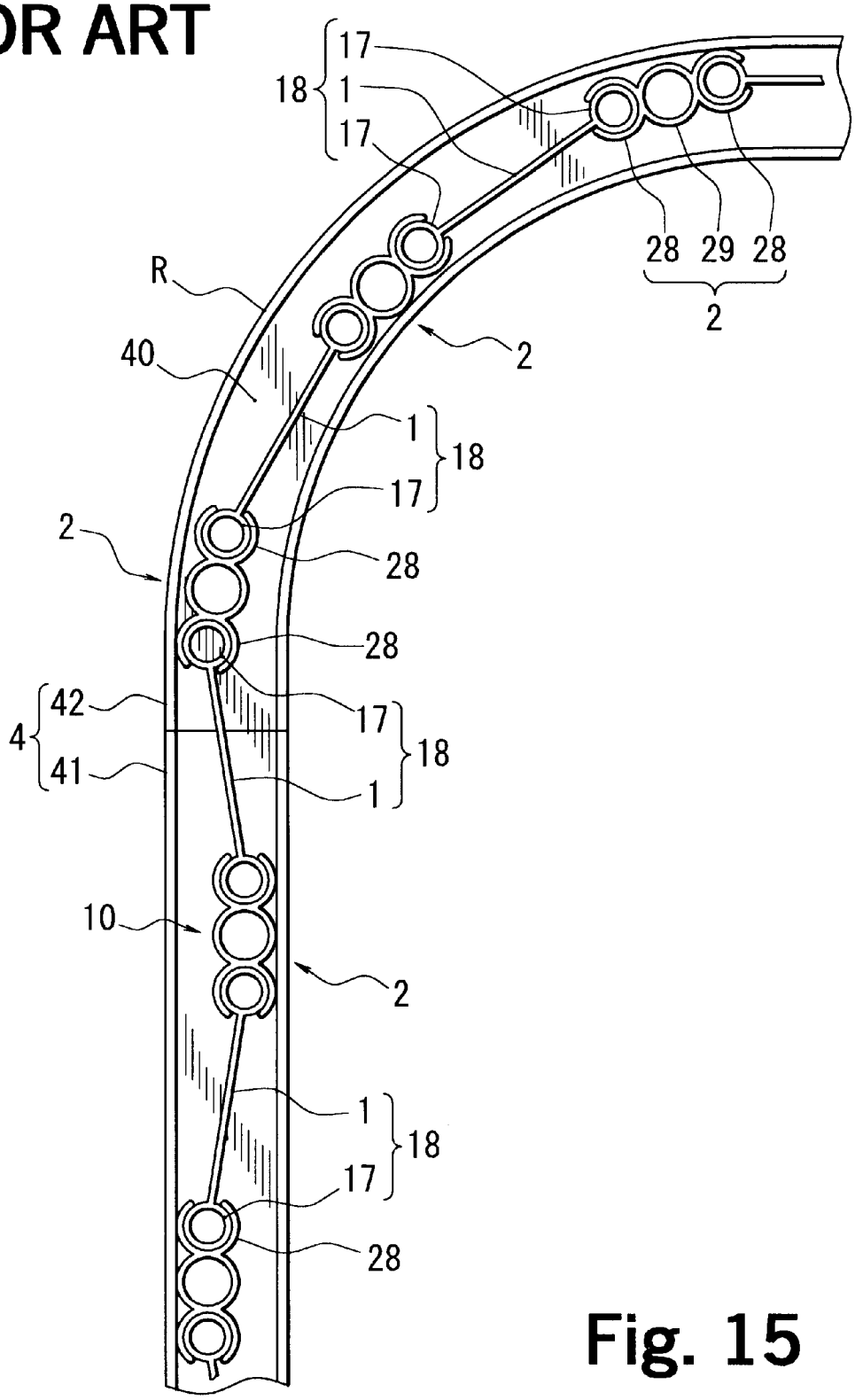
FIG. 15 is an explanatory view showing a sliding state of a shutter panel of the conventional technique.

As shown in FIG. 12, the escape-preventing plate 6 is a thin plate member which substantially coincides with a sectional shape of the hinge member 2, and is formed at its central portion with an insertion hole 60 which is brought into communication with the cylindrical portion 21 of the hollow portion 20 of the hinge member 2 when the escape-preventing plate 6 abuts against the end surface of the hinge member 2 such that the escape-preventing plate 6 substantially coincides with the end surface of the hinge member 2. Further, the escape-preventing plate 6 is formed at its upper portion with a projection 61 which is engaged with an upper step 22*a* of the angular cylindrical portions 22 of the hollow portion 20 in a state in which it is mounted to the hinge member 2 as shown in FIG. 13.

The roller 7 includes a threaded portion 70 which is threadedly engaged with the cylindrical portion 21 of the hollow portion 20, and a rotating head 71 which rotates around the threaded portion 70. The threaded portion 70 is formed with a circular flange 72 which has a diameter greater than that of the insertion hole 60 of the escape-preventing plate 6 and which pushes the escape-preventing plate 6 against the end surface of the hinge member 2.

Since this embodiment has such a configuration, when the opposite end edges of the shutter panel 10 slide along the guide rails 4, the roller 7 rotates in the guide grooves 40. Therefore, the shutter panel 10 smoothly slides along the guide grooves 40 by the rotation motion of the roller 7. Further, the extension piece 100 is also held in the guide grooves together with the roller 7, a gap is less prone to be generated between the end edge of the short side of the plate 1 and the end edge of the guide rail 4, and liquid such as water is prevented from flowing from the gap into the shutter, and is prevented from flowing outside from the inside the shutter.

According to this embodiment, since the opened end of the side groove 3 in the longitudinal direction is closed by the escape-preventing plate 6, the plate 1 which is slidably held by the side groove 3 slides in the longitudinal direction and jumps out from the side groove 3 and the opposite end edges of the shutter panel 10 are prevented from being irregularly arranged. Therefore, it is possible to smoothly slide the shutter panel 10 without being caught by the guide groove 40.

Further, according to this embodiment, since the projection 61 of the escape-preventing plate 6 and the hollow portion 20 of the hinge member 2 are engaged with each other, positioning of the escape-preventing plate 6 is easy when the escape-preventing plate 6 abuts against the hinge member 2, and the escape-preventing plate 6 abuts against the end surface of the hinge member 2 such that the escape-preventing plate 6 is prevented from being turned.

What is claimed is:

1. A shutter comprising:

a shutter panel having a plurality of plates rotatably connected to one another by hinge members; and a pair of guide rails formed with guide grooves for slidably holding opposite end edges of the shutter panel; wherein each of the hinge members connects the adjacent plates so that the plates can be rotatably bent only in a direction in which the curvature becomes greater than a minimum curvature portion of the guide groove; and wherein the hinge member is a columnar body connecting long sides of the adjacent plates, a pair of side grooves for holding the plate so that the plate is rotatable and is prevented from being pulled out are formed on side walls of the hinge member, and each of the side grooves is formed with reverse movement-preventing means for abutting against the plate to prevent the plate from rotating in a direction opposite from a direction in which the curvature of the guide groove becomes great when the adjacent plates are arranged straightly through the hinge members, and normal movement-preventing means for abutting against the plate to prevent the plate from rotating in the normal direction when the plate is rotated in the normal direction in which the curvature becomes great through a predetermined angle; and further wherein one of the opened end edges of the side groove is formed with a projecting portion along a longitudinal direction thereof, one of the surfaces of the plate is formed, along a longitudinal direction of the plate, with a recessed groove into which the projecting portion is rotatably fitted, the reverse movement-preventing means is the other opened end edge of the side groove which abuts against the other surface of the plate, and the normal movement-preventing means is one of the opposed inner walls of the side groove which is formed to abut against and support the end edge of the plate when the plate is rotated in the normal direction through a predetermined angle.

2. The shutter according to claim 1, wherein the other one of the opposed inner walls of the side groove is formed to abut against and support the end edge of the plate when the adjacent plates are arranged straightly through the hinge members.

3. The shutter according to claim 1, wherein the hinge member is a columnar body having a rectangular section which is longer in a widthwise direction of the guide groove slidably holding the shutter panel, and the pair of side grooves are formed on the side of the reverse direction of the plate which is rotatably held by the side grooves.

4. The shutter according to claim 1, wherein the side groove is formed so that the height of the groove side wall located on the side of the reverse direction of the plate is greater than the height of the groove side wall located on the side of the normal direction of the plate.

5. The shutter according to claim 1, further comprising roller members connected to the opposite ends of the hinge members and mounted in the guide grooves, wherein the roller members rotate in the guide grooves along the sliding direction of the shutter panel, and opposite end edges of the plate on the transverse side hereof having extension pieces which have substantially the same length as the projecting length of the roller member from the end of the hinge member, and accommodated between adjacent roller members.

6. The shutter according to claim 1, wherein the hinge member holds the long side of the plate so that the plate can slide in its longitudinal direction and the plate is prevented from being disconnected from the hinge member when the plate is pulled in its transverse direction, and pull-out preventing members mounted to the opposite ends of the hinge member for preventing the plate from being slidably disconnected from the hinge member when the plate is pulled in is longitudinal direction.

7. A shutter comprising:

a shutter panel having a plurality of plates rotatably connected to one another by hinge members; and a pair of guide rails formed with guide grooves for slidably holding opposite end edges of the shutter panel; wherein each of the hinge members connects the adjacent plates so that the plates can be rotatably bent only in a direction in which the curvature becomes greater than a minimum curvature portion of the guide groove; and wherein the hinge member is a columnar body connecting long sides of the adjacent plates, a pair of side grooves for holding the plate so that the plate is rotatable and is prevented from being pulled out are formed on side walls of the hinge member, and each of the side grooves is formed with reverse movement-preventing means for abutting against the plate to prevent the plate from rotating in a direction opposite from a direction in which the curvature of the guide groove becomes great when the adjacent plates are arranged straightly through the hinge members, and normal movement-preventing means for abutting against the plate to prevent the plate from rotating in the normal direction when the plate is rotated in the normal direction in which the curvature becomes great through a predetermined angle; and further wherein one of the opened end edges of the side groove is formed with a projecting portion along a longitudinal direction thereof, the end edge of the plate is formed, along a longitudinal direction thereof, with a protruding portion which engages with the projecting portion so that the plate is rotatable, the reverse movement-preventing means is the other opened end edge of the side groove which abuts against the other surface of the plate, and the normal movement-preventing means is one of the opposed inner walls of the side groove which is formed to abut against and support the end edge of the plate when the plate is rotated in the normal direction through a predetermined angle.

8. The shutter according to claim 7, wherein the other one of the opposed inner walls of the side groove is formed to abut against and support the end edge of the plate when the adjacent plates are arranged straightly through the hinge members.

9. The shutter according to claim 7, wherein the hinge member is a columnar body having a rectangular section which is longer in a widthwise direction of the guide groove slidably holding the shutter panel, and the pair of side grooves are formed on the side of the reverse direction of the plate which is rotatably held by the side grooves.

10. The shutter according to claim 7, wherein the side groove is formed so that the height of the groove side wall located on the side of the reverse direction of the plate is greater than the height of the groove side wall located on the side of the normal direction of the plate.

11. The shutter according to claim 7, further comprising roller members connected to the opposite ends of the hinge members and mounted in the guide grooves, wherein the roller members rotate in the guide grooves along the sliding direction of the shutter panel, and opposite end edges of the plate on the transverse side hereof having extension pieces which have substantially the same length as the projecting length of the roller member from the end of the hinge member, and accommodated between adjacent roller members.

12. The shutter according to claim 7, wherein the hinge member holds the long side of the plate so that the plate can slide in its longitudinal direction and the plate is prevented from being disconnected from the hinge member when the plate is pulled in its transverse direction, and pull-out preventing members mounted to the opposite ends of the hinge member for preventing the plate from being slidably disconnected from the hinge member when the plate is pulled in is longitudinal direction.

13. A shutter comprising:

a shutter panel having a plurality of plates rotatably connected to one another by hinge members; and a pair of guide rails formed with guide grooves for slidably holding opposite end edges of the shutter panel; wherein each of the hinge members connects the adjacent plates so that the plates can be rotatably bent only in a direction in which the curvature becomes greater than a minimum curvature portion of the guide groove; and wherein the hinge member is a columnar body connecting long sides of the adjacent plates, a pair of side grooves for holding the plate so that the plate is rotatable and is prevented from being pulled out are formed on side walls of the hinge member, and each of the side grooves is formed with reverse movement-preventing means for abutting against the plate to prevent the plate from rotating in a direction opposite from a direction in which the curvature of the guide groove becomes great when the adjacent plates are arranged straightly through the hinge members, and normal movement-preventing means for abutting against the plate to prevent the plate from rotating in the normal direction when the plate is rotated in the normal direction in which the curvature becomes great through a predetermined angle; and further wherein the hinge member is a hinge cylinder having a structure in which an inner cylinder is connected to one plate and an outer cylinder is connected to an adjacent plate and the inner and outer cylinders are rotatably fitted to each other, the hinge cylinder is formed with reverse movement-preventing means for preventing the hinge cylinder from rotating in a direction opposite from a direction in which the curvature of the guide groove becomes great when the adjacent plates are arranged straightly through the hinge cylinders, and normal movement-preventing means for preventing the hinge cylinder from rotating in the normal direction when the plates rotate through a predetermined angle in the normal direction in which the curvature becomes great.

14. A shutter comprising:

a shutter panel having a plurality of plates rotatably connected to one another by hinge members; and a pair of guide rails formed with guide grooves for slidably holding opposite end edges of the shutter panel; wherein each of the hinge members connects the adjacent plates so that the plates can be rotatably bent only in a direction in which the curvature becomes greater than a minimum curvature portion of the guide groove; and wherein the hinge member is a columnar body connecting long sides of the adjacent plates, a pair of side grooves for holding the plate so that the plate is rotatable and is prevented from being pulled out are formed on side walls of the hinge member, and each of the side grooves is formed with reverse movement-preventing means for abutting against the plate to prevent the plate from rotating in a direction opposite from a direction in which the curvature of the guide groove becomes great when the adjacent plates are arranged straightly through the hinge members, and normal movement-preventing means for abutting against the plate to prevent the plate from rotating in the normal direction when the plate is rotated in the normal direction in which the curvature becomes great through a predetermined angle; and further comprising roller members connected to the opposite ends of the hinge members and mounted in the guide grooves, wherein the roller members rotate in the guide grooves along the sliding direction of the shutter panel, and opposite end edges of the plate on the transverse side thereof having extension pieces which have substantially the same length as the projecting length of the roller member from the end of the hinge member, and accommodated between adjacent roller members.

15. A shutter comprising:

a shutter panel having a plurality of plates rotatably connected to one another by hinge members; and a pair of guide rails formed with guide grooves for slidably holding opposite end edges of the shutter panel; wherein each of the hinge members connects the adjacent plates so that the plates can be rotatably bent only in a direction in which the curvature becomes greater than a minimum curvature portion of the guide groove; and wherein the hinge member is a columnar body connecting long sides of the adjacent plates, a pair of side grooves for holding the plate so that the plate is rotatable and is prevented from being pulled out are formed on side walls of the hinge member, and each of the side grooves is formed with reverse movement-preventing means for abutting against the plate to prevent the plate from rotating in a direction opposite from a direction in which the curvature of the guide groove becomes great when the adjacent plates are arranged straightly through the hinge members, and normal movement-preventing means for abutting against the plate to prevent the plate from rotating in the normal direction when the plate is rotated in the normal direction in which the curvature becomes great through a predetermined angle; and further wherein the hinge member holds the long side of the plate so that the plate can slide in its longitudinal direction and the plate is prevented from being disconnected from the hinge member when the plate is pulled in its transverse direction, and pull-out preventing members mounted to the opposite ends of the hinge member for preventing the plate from being slidably disconnected from the hinge member when the plate is pulled in is longitudinal direction.

* * * * *